US006389725B1

(12) United States Patent
Denuit

(10) Patent No.: US 6,389,725 B1
(45) Date of Patent: May 21, 2002

(54) FIRE ARM WITH FORWARD EJECTION OR EJECTION BROUGHT TO THE FORE-PART OF THE FIRE ARM

(75) Inventor: Charles Denuit, Juprelle (BE)

(73) Assignee: FN Herstal, S.A., Herstal (BE)

( * ) Notice: Subject to any disclaimer, the term of this patent is extended or adjusted under 35 U.S.C. 154(b) by 0 days.

(21) Appl. No.: 09/512,749

(22) Filed: Feb. 25, 2000

(30) Foreign Application Priority Data

Mar. 4, 1999 (BE) ..... 9900155

(51) Int. Cl.[7] ..... F41A 15/00
(52) U.S. Cl. ..... 42/25
(58) Field of Search ..... 42/25

(56) References Cited

U.S. PATENT DOCUMENTS

| | | | | |
|---|---|---|---|---|
| 2,350,477 A | * | 6/1944 | Rowley | 42/25 |
| 2,712,192 A | * | 7/1955 | Dixon et al. | 42/25 |
| 3,110,220 A | * | 11/1963 | Austin et al. | 42/25 |
| 3,120,071 A | * | 2/1964 | Pernini | 42/25 |
| 3,680,240 A | * | 8/1972 | Barr et al. | 42/25 |
| 4,676,017 A | | 6/1987 | Hürlermann et al. | |
| 5,289,755 A | * | 3/1994 | Zielinski et al. | 89/47 |
| 5,675,924 A | * | 10/1997 | Predazzer | 42/25 |

FOREIGN PATENT DOCUMENTS

| | | |
|---|---|---|
| EP | 0 717 255 A1 | 6/1996 |
| FR | 761171 | 3/1934 |
| GB | 222784 | 10/1924 |

* cited by examiner

*Primary Examiner*—Michael J. Carone
*Assistant Examiner*—M Thomson
(74) *Attorney, Agent, or Firm*—Bacon & Thomas, PLLC

(57) ABSTRACT

The fire arm contains a frame, a barrel (2) and mobile elements (4) containing an extractor to carry along a casing during the recoil and an element (7) to close the fire chamber (3). The fire arm further contains an ejection device with an ejector (25,26) mounted in this closing element (7), and guiding means for the casing which make this casing swivel during the ejection. This arm contains a lever mounted next to the extractor in a swiveling manner on one of the other mobile elements (4), whereby this lever is provided with a cam working in conjunction with the extractor. The frame is provided with a control stop situated in the trajectory of the lever during the forward movement of the mobile elements (4), making the lever swivel when the casing must be released from the extractor.

10 Claims, 10 Drawing Sheets

FIRE ARM WITH FORWARD EJECTION OR EJECTION BROUGHT TO THE FORE-PART OF THE FIRE ARM

BACKGROUND OF THE INVENTION

1. Field of the Invention

The invention concerns a fire arm with an automatic or manual cycle, with a forward ejection of the cartridge casing or an ejection of the cartridge casing brought to the fore-part of the fire arm, whereby this fire arm contains a frame, a barrel mounted on this frame and which is equipped with a fire chamber and mobile elements which can be moved backward in relation to the frame during the recoil, whereby the mobile elements contain an extractor to carry along a casing during the recoil and an element to close the fire chamber, whereby the fire arm further contains an ejection device with an ejector mounted in this closing element, and guiding means for the casing which allow for the passage of the casing during the recoil of the mobile elements and thus for the extraction, but which make the casing tilt during the ejection.

2. Discussion of the Related Art

The invention in particular concerns what are called "bull pup" guns whereby the course of the mobile elements is integrated in the grip.

As the ejection of the cartridge casing is advanced and the casing is deflected in the most appropriate direction by means of a deflector at the output of the ejection tube, the risk of any interference of the ejection trajectory of the casing with the shooter, namely with his face, is suppressed.

Such arms are advantageous in that they are ambidextrous and thus compatible with left-handed shooters as well as right-handed shooters.

A known fire arm of this type is described in European Patent No. 0.717.255 (U.S. Pat. No. 5,675,924).

In this arm, the guiding means of the ejection device consist of an ejection lever mounted in a swiveling manner around an axis and containing a guiding part provided with a passage for a cartridge casing, whereby this ejection lever tilts between a lower position in which the entry of its passage is situated in the trajectory of the casing when the mobile elements return forward, and a top position, a button being provided to eject the casing out of the passage when the ejection lever approaches its top position, whereby this button preferably forms a whole with one of the mobile elements.

What may happen with these arms, is that on the moment when the casing is tilted so as to be ejected forward, the extractor still catches the neck of the casing, thus hindering a normal ejection and a new feeding.

SUMMARY OF THE INVENTION

The invention aims to remedy this disadvantage and to make sure that the extractor releases the casing when it is tilted.

To this aim, the fire arm contains a lever mounted next to the extractor in a swiveling manner on one of the other mobile elements, whereby this lever is provided with an eccentric cam working in conjunction with the extractor mounted in a tilting manner, such that, when the lever swivels, this cam can make the extractor tilt and thus cause it to release the cartridge casing, whereby the frame is provided with at least one control stop situated in the trajectory of the lever during the forward movement of the mobile elements, making the lever swivel during this movement as mentioned above at the moment when the casing must be released from the extractor.

The lever can be mounted on the slide in a swiveling manner.

Preferably, means are provided to put the lever back into a position, after said swiveling, in which the cam allows the extractor to return into the position in which it was situated prior to its tilting.

Said means for putting the lever back may contain a release spring acting on the lever.

These means may also contain a return stop, fixed in relation to the frame, situated more to the front than said control stop.

DESCRIPTION OF THE PREFERRED EMBODIMENT

In order to better explain the characteristics of the invention, the following embodiment of the invention is described as an example only without being limitative in any way, with reference to the accompanying drawings, in which.

Figure 1:
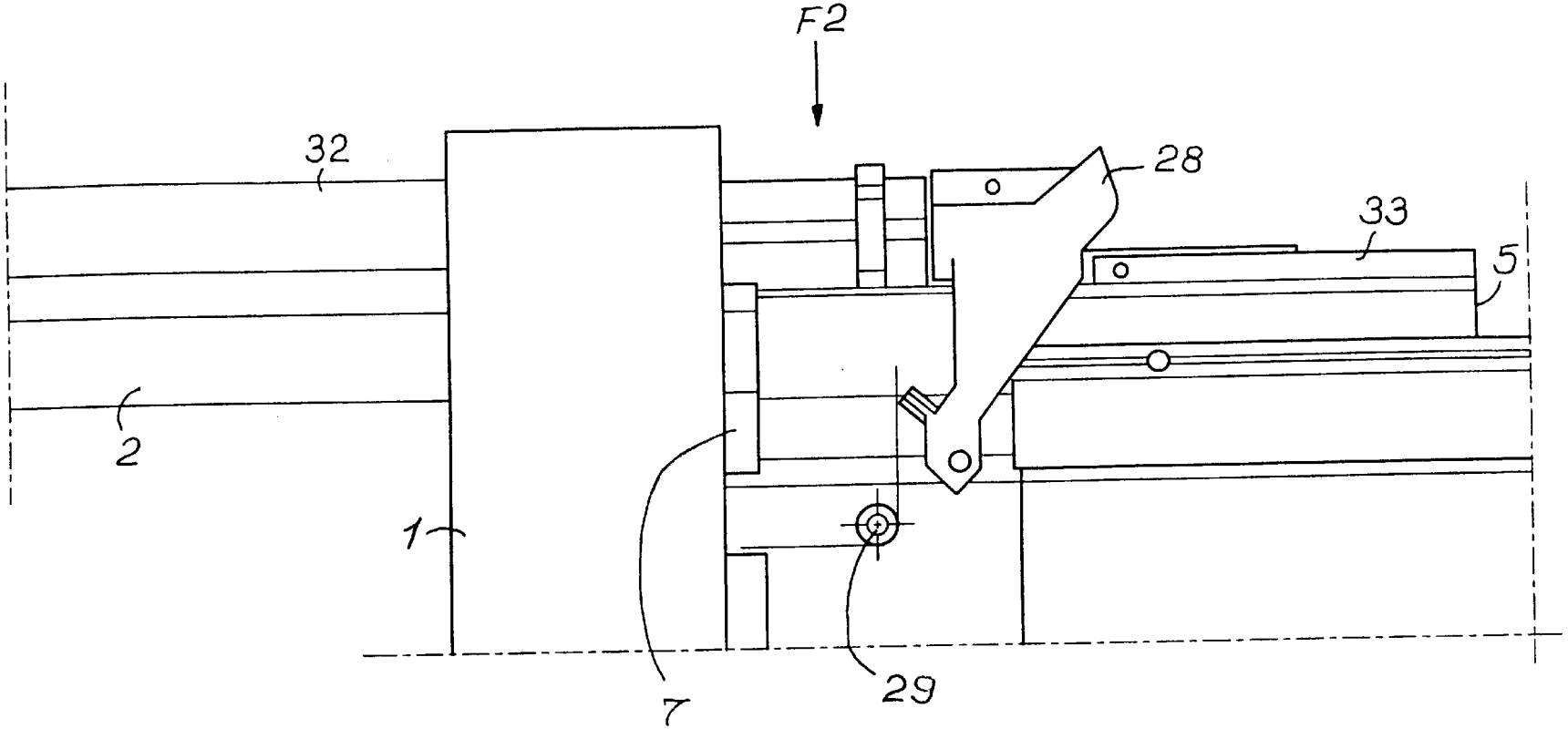
FIG. 1 represents a schematic side view of a part of a fire arm of the invention.
Figure 2:
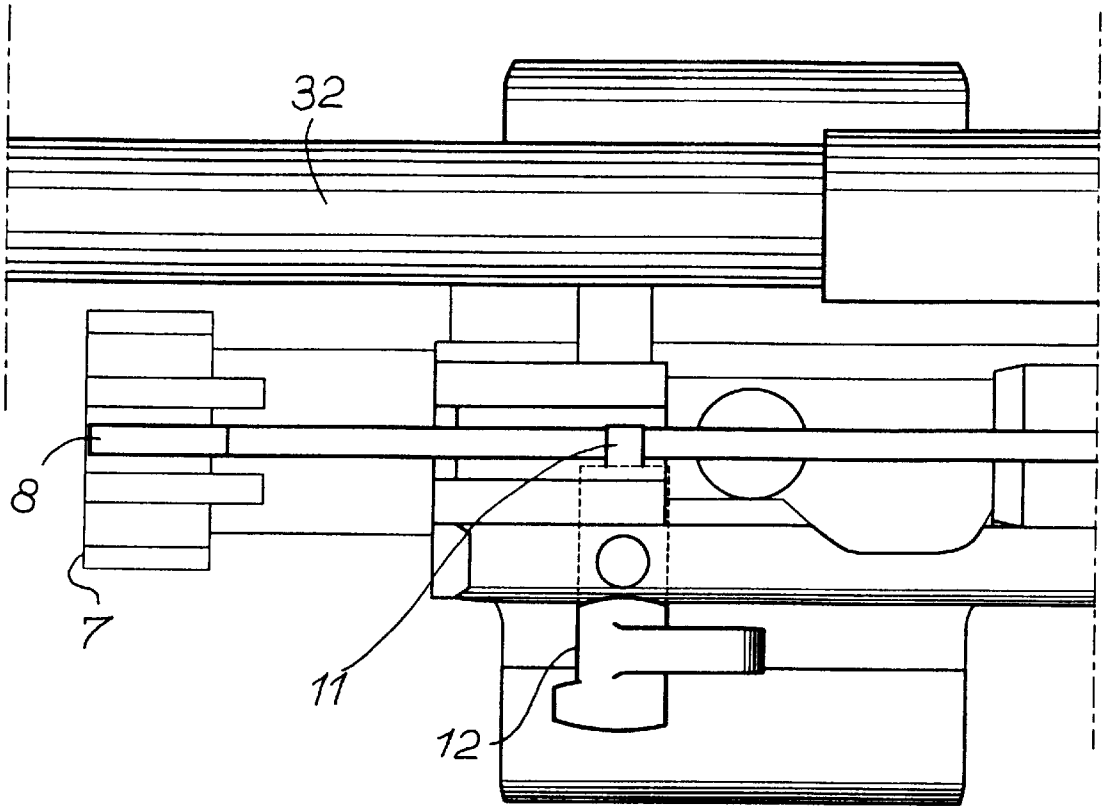
FIG. 2 represents a front view of arrow F2 indicated in FIG. 1.
Figure 3:
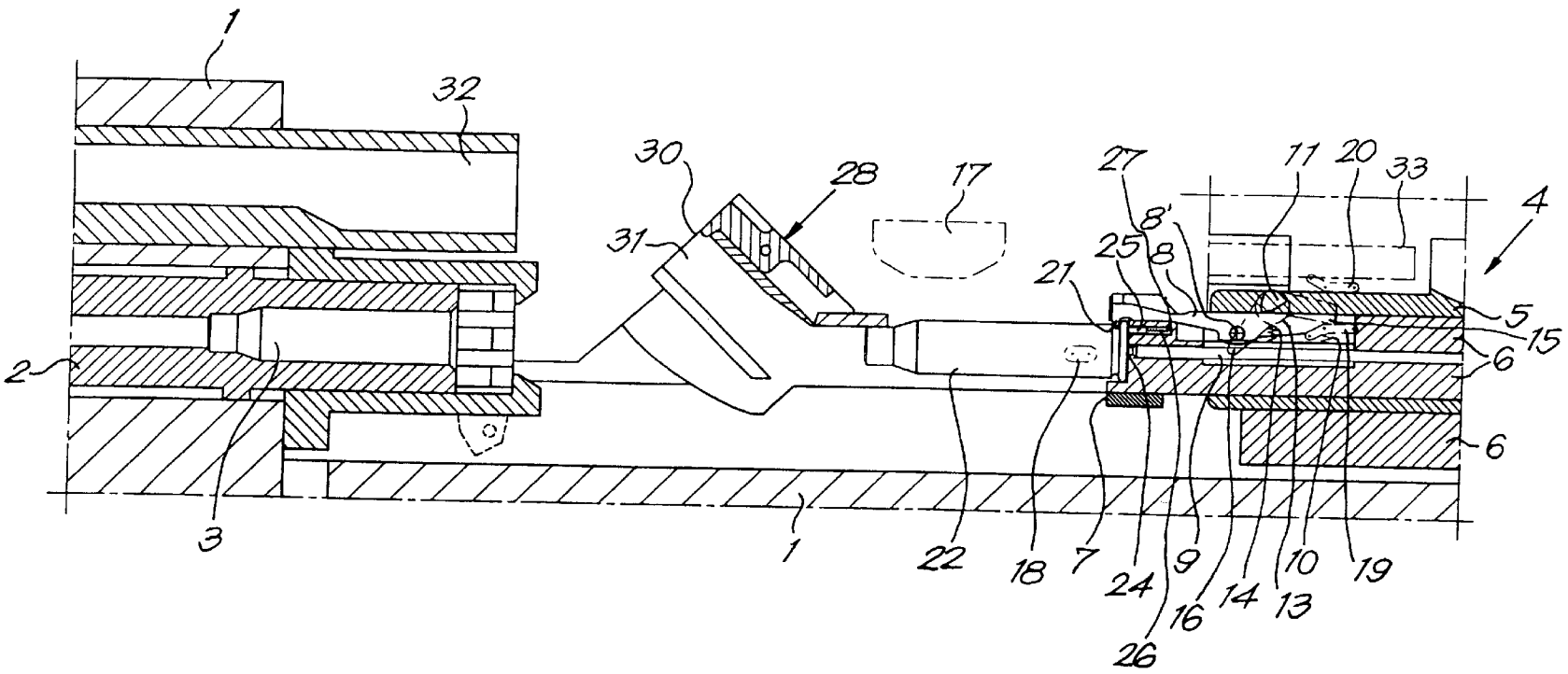
FIG. 3 represents a longitudinal section of the part of the fire arm from FIG. 1, but related to another position, i.e. at the moment of the ejection.

FIGS. 1 to 3 represent a part of a gas-operated fire arm and a rotating lock containing a frame 1, a barrel 2 mounted on this frame 1 and provided with a fire chamber 3 in the back, and a number of mobile elements 4 which move backward at the time of the recoil.

Said mobile elements 4 contain the slide 5, the breech bolt 6 provided with a closing element 7 at the front which closes the fire chamber 3 when a shot is fired, the extractor 8 and the firing pin 9.

This extractor 8 swivels over the slide 5 around a transversal axis 8', whereby a spring 10 acts on the rear end pushing this extractor 8 into its extraction position as represented in FIG. 3.

A cam 11, mounted on a release lever 12, works in conjunction with the rear part of said extractor 8 and can make it swivel against the spring 10.

This lever 12 is provided on the slide 5 and includes a transversal axle 13 enabling pivoting of the lever 12 in this slide 5. A return spring 14, which is mounted for example between a part of the slide and a flattened part of the axle 13, exerts a restoring torque on this axle 13 during its rotation.

The cam 11 is situated on one far end of the axle 13.

This lever 12 contains a top arm 15 and a lower arm 16 forming an obtuse angle between them, whereby, during the movement of the slide 5, these two arms work in conjunction with stops which are situated on the frame 1, namely, from the front to the back, a lower return stop 17, a top control stop 18 and a pair of guiding stops 19 and 20.

Figure 4:
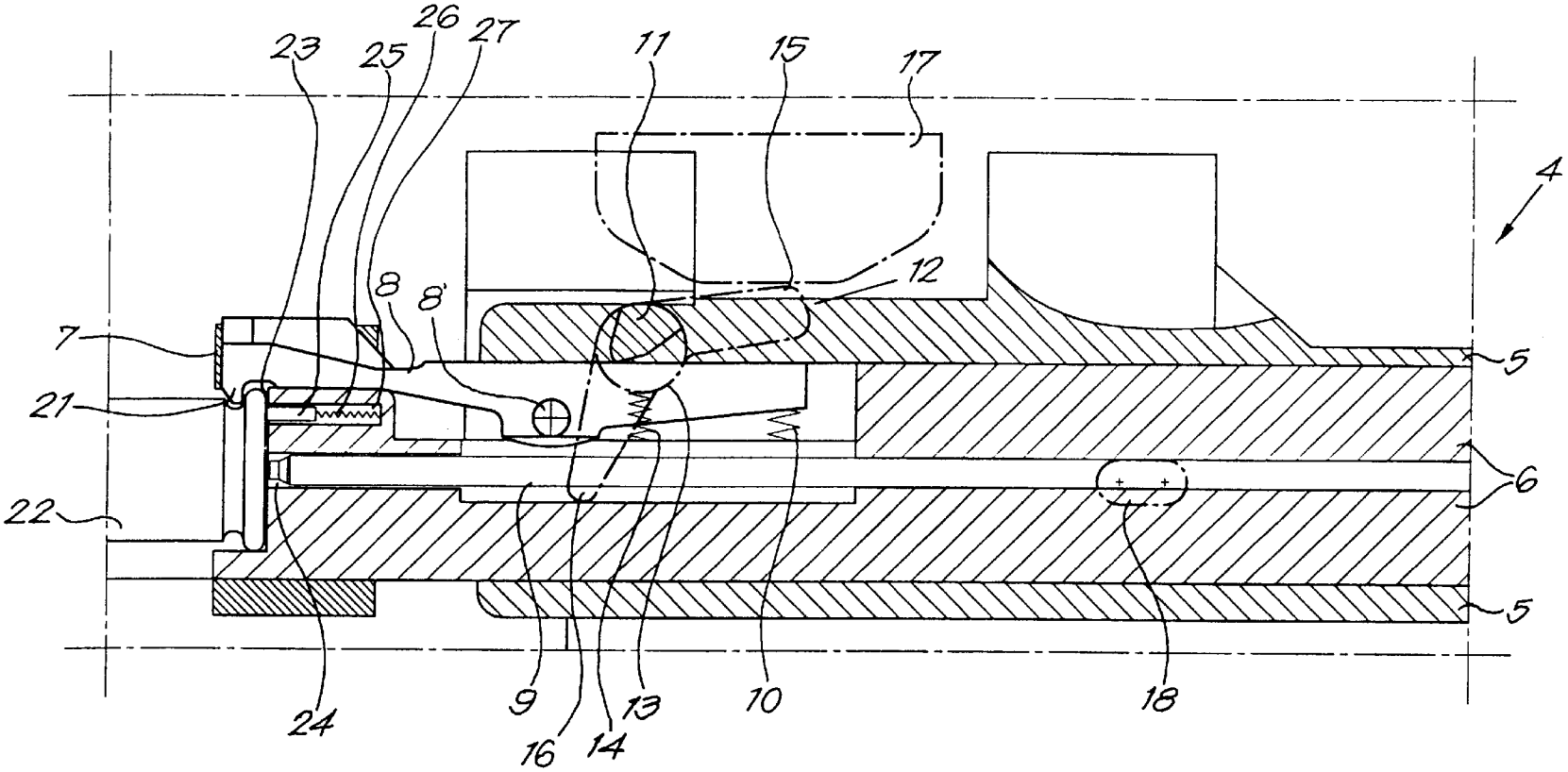
FIGS. 4 to 10 represent a part of the section from FIG. 3 to a larger scale, but with reference to different successive stages of the extraction and the ejection of the cartridge casing.

The extractor 8 has a conventional design and its front end forms a hook 21 which can catch the neck of a casing 22 of a cartridge which has either or not been shot, situated in the fire chamber 3, as represented in detail in FIG. 4.

These stops 17 to 20 are situated in a place such that, when the extractor 8 has to release an extracted cartridge casing 22 so as to allow for the ejection, the lever 12 is swiveled such that the cam 11 makes the extractor 8 swivel, as will be explained in detail below.

The above-mentioned closing element 7 of the breech bolt 6 has a front side 23 and is intersected by an axial opening 24 for the firing pin 9.

An ejection device, containing an ejector, consisting of a button 25 with a spring 26, i.e. a trigger, and mounted in an opening 27 in the closing element 7, is provided whereby the spring 26 pushes the button 25 outward.

Apart from the above-mentioned ejector 25,26, the ejection device contains guiding means consisting of an ejection lever 28 and mounted in the back of the fire chamber 3. This lever 28 swivels in relation to the frame 1 around a transversal axis 29 between a lower position represented in FIG. 3 and a top position represented in FIG. 1.

The ejection lever 28 contains a guiding part 30, intersected by a passage 31 for the casing 22.

In the lower position, the entry of the passage 31 which is directed slantingly upward, is situated on the trajectory of the casing 22 when the mobile elements 4 return forward again.

In the top position, the guiding part 30 is situated above the trajectory of the casing 22, whereby this casing 22 can go under said guiding part 30 as the casing 22 recoils and is thus extracted.

In this top position, the passage 31 opens forwardly into an ejection tube 32 mounted on the frame 1, above the barrel 2.

In order to make it possible to eject a casing 22 outside the passage 31, a button 33 is mounted on the slide 5.

The extraction and forward ejection of a casing 22 in the above-described fire arm are in principle carried out in a known manner, as described for example in European patent No. 0.717.255. Hence, the extraction and ejection will only be described hereafter as far as necessary in order to understand the invention and thus insofar as they differ from what is known.

At the moment of the shooting, the mobile elements 4 are situated in their front position and they recoil as a result of the shooting.

During the recoil movement of the mobile elements 4, the hook 21 of the extractor 8 catches the neck of the casing 22.

As the ejector 25,26 is situated close to the extractor 8, the ejector 25,26 does not exert any significant torque on the casing 22, which thus remains in its position against the front side 23 of the closing element 7 during the complete recoil of the mobile elements 4.

When the recoil begins, the top arm 15 of the lever 12 makes contact with the return stop 17, and the lever 12 is situated in the position as represented in FIG. 4.

The cam 11 does not act on the extractor 8, which remains in its extraction position.

Figure 5:
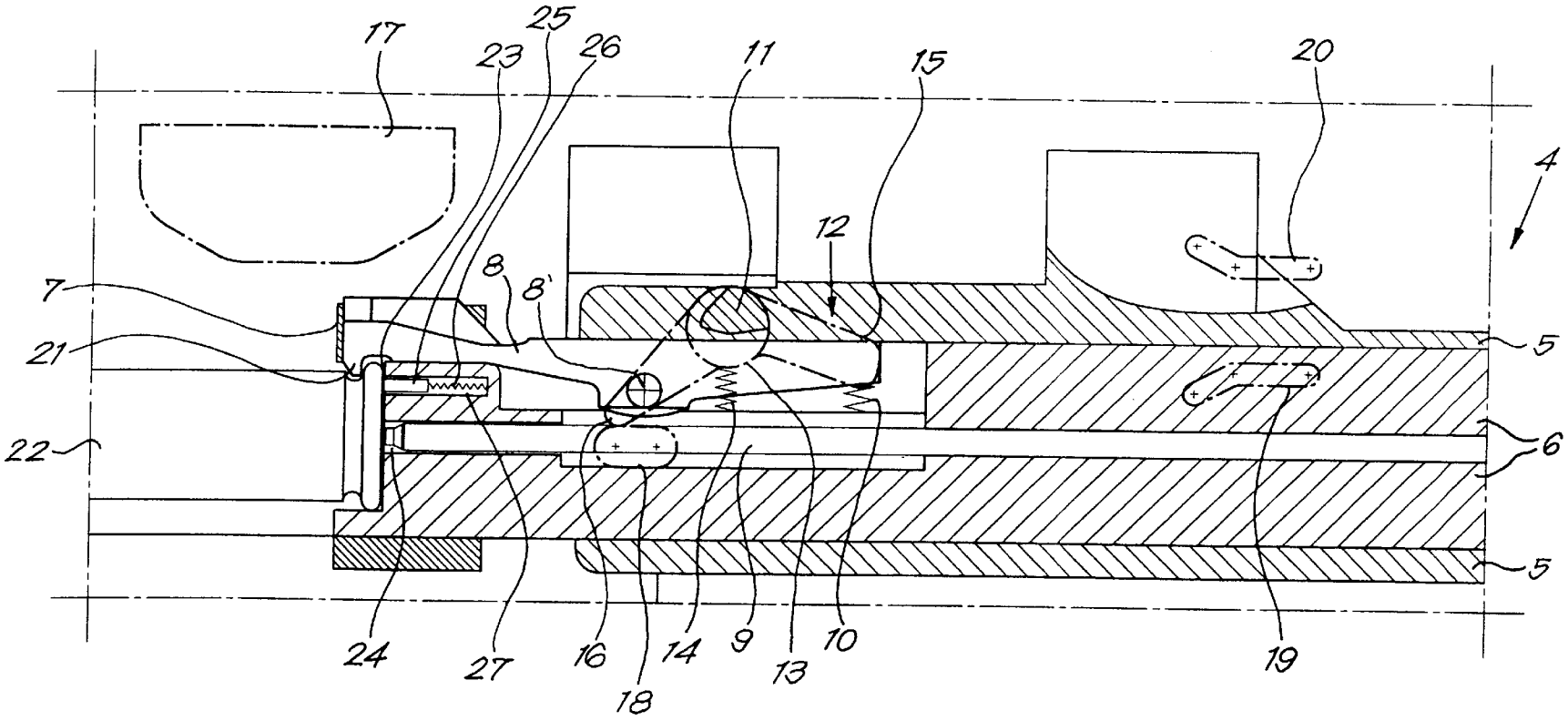

At a given moment, the lower arm 16 makes contact with the control stop 18 which is situated lower and more to the back in relation to the return stop 17, on the trajectory of the arm 16, whereby this arm 16 is forced to swivel towards the position as represented in FIG. 5 in order to pass this control stop 18.

Past this stop, the lever 12 swivels thanks to the effect of the return spring 14 into a rest position.

At the end of the recoil, it is the top arm 15 which makes contact with the lower guiding stop 19 and which is guided in between the guiding stops 19 and 20. Possible oscillations of the lever 12 are stopped, and the lever 12 is forced into the position represented in FIG. 6.

After the recoil, the casing 22 comes forward again, still driven by the extractor 8 and the other mobile elements 4 and still in its position where it makes contact with the above-mentioned front side 23.

As soon as the lever 12 leaves the funnel formed by the guiding stops 19 and 20, the lever 12 goes back into its rest position thanks to the effect of the return spring 14.

Figure 7:
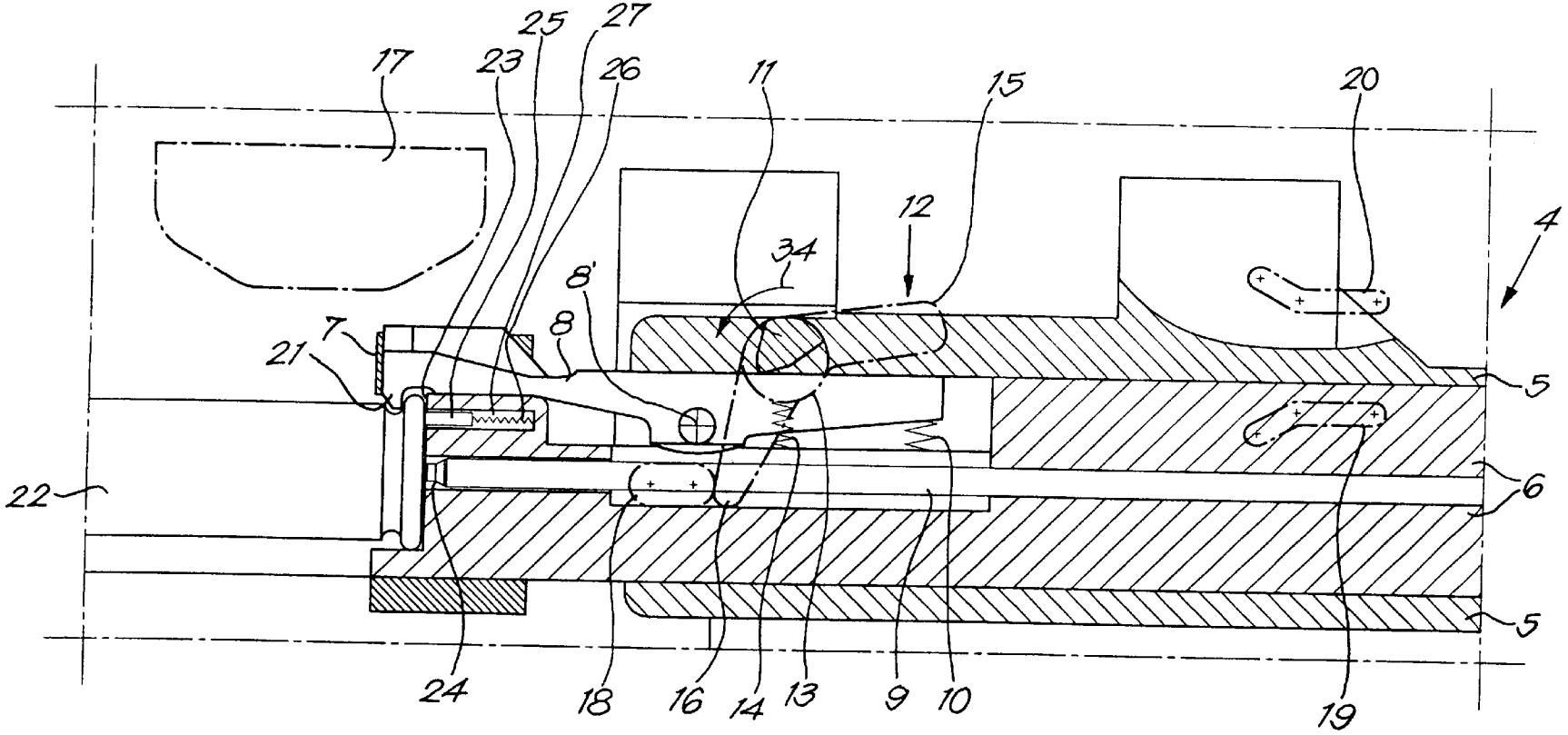
Figure 8:
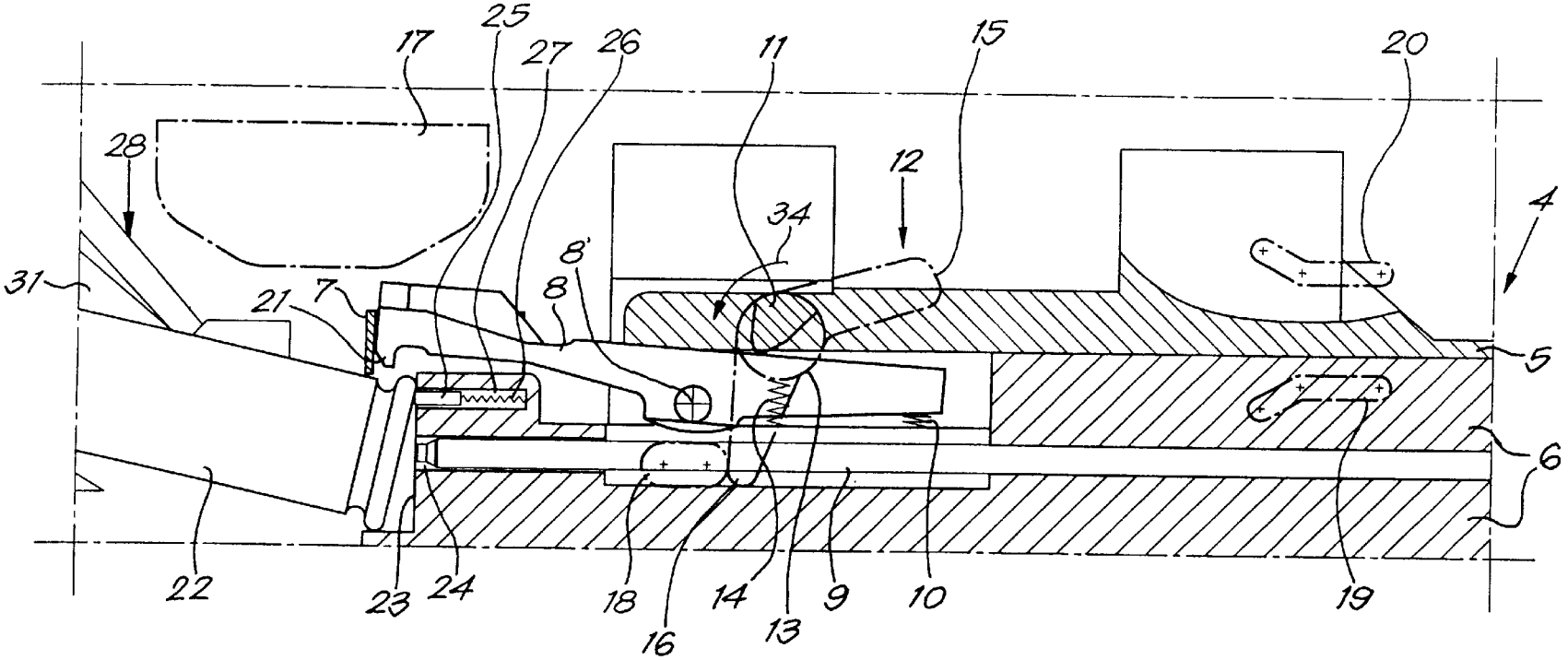
Figure 9:
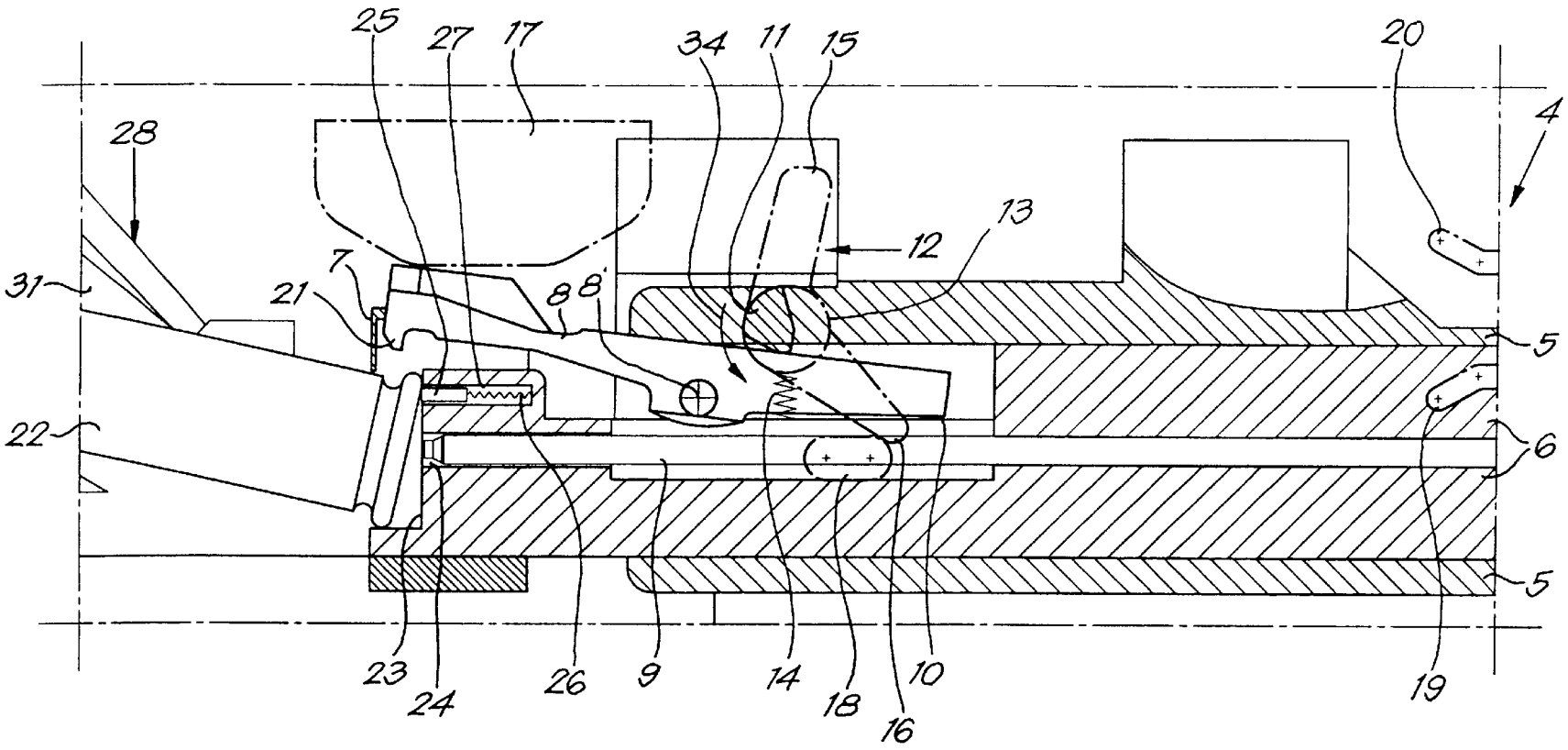

The trajectory which is then followed by the far end of the lower arm 16 during said return movement goes through the control stop 18, and when this arm 16 again hits the control stop 18, the lever 12 must swivel in the direction indicated in FIGS. 7 to 9 by the arrow 34, as the lever 12 is moved forward together with the slide 5.

It is clear that, when the lever 12 swivels, the cam 11 makes a circular movement around the swivel pin of the lever 12.

Figure 6:
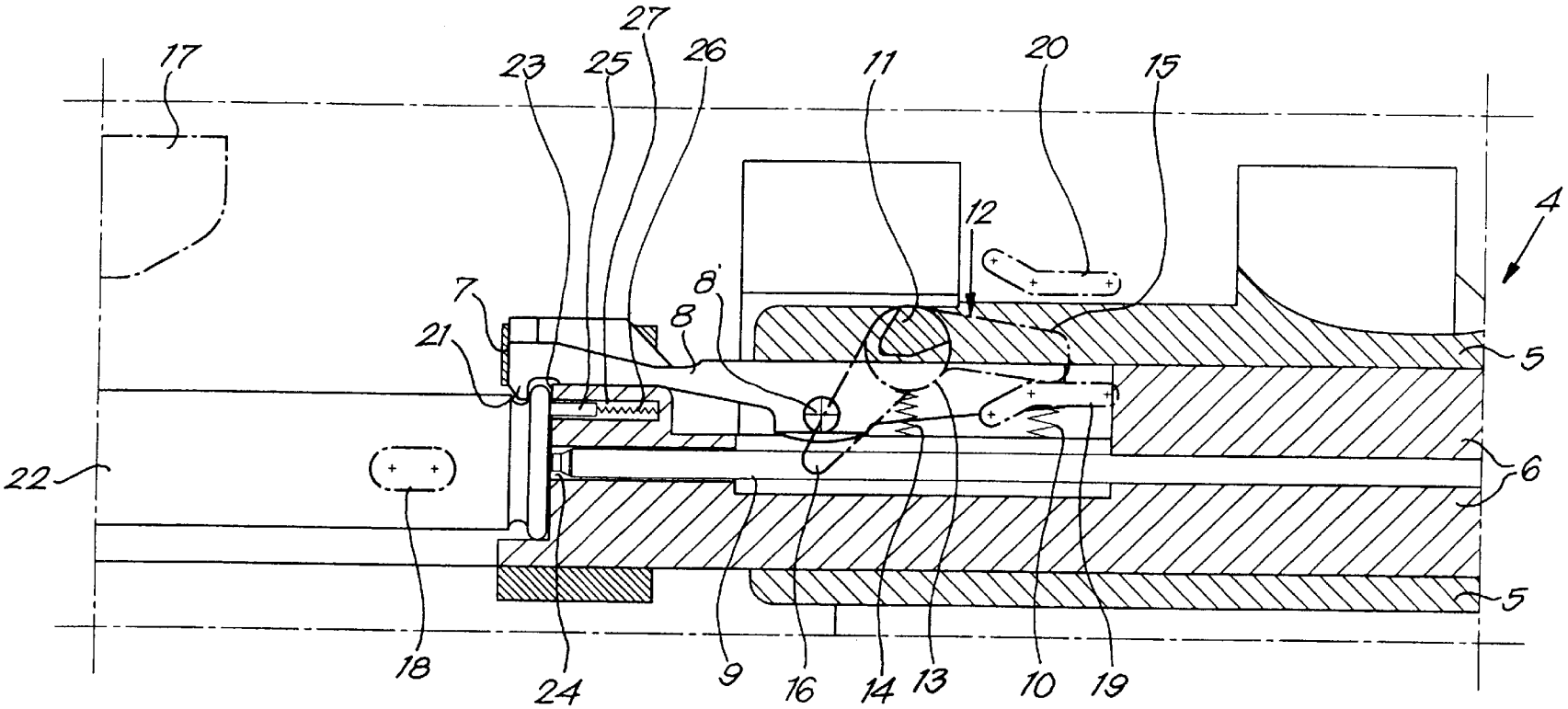

During the above-mentioned swivel movements of the lever 12 during the recoil, as well as during the swivel movement between its position represented in FIG. 6 and its position represented in FIG. 7, the cam does not exert any positive action whatsoever on the extractor 8.

Between the moment when the extractor 8 and the other mobile elements 4 are situated in the position represented in FIG. 7 and the moment when the extractor 8 and these elements 4 are situated in the position represented in FIG. 8, the casing 22 enters the passage 31 of the ejection lever 28 which is in the meantime situated in its lower position as represented in FIG. 3.

The ejection lever 28 makes the casing 22 swivel towards the top until the coupled action resulting from the geometry of the front part of the extractor and of the ejector button 25 normally releases the casing 22 from the extractor 8 as represented in FIG. 8.

Simultaneously, as a result of the swiveling of the lever 12, the cam 11 pushes the rear part of the extractor 8 down, making it swivel as represented in FIGS. 8 and 9.

The extractor 8 has been maximally swiveled when the lever 12 is situated in the position represented in FIG. 8, thus guaranteeing the complete release of the casing 22 as mentioned above.

As of this moment, the casing 22 is guided by the ejection lever 28 which is now going to be pushed back in its top position by the mobile elements 4, after which the casing 22 is pushed forward again outside the passage 31 and in the ejection tube 32 by the button 33 which is driven by the mobile elements 4.

During the forward return of the mobile elements 4 and thus the lifting and the ejection of the casing 22, the next cartridge is fed in the conventional manner.

Before these mobile elements 4 reach their front position, the lever 12 is again swiveled in the direction opposite to the one indicated by the arrow 34. As a result, the cam 11 reduces the pressure on the extractor 8 and the latter starts to turn back into its original extraction position due to the action of the spring 10.

It is not certain that, past the control stop 18, the above-mentioned return swiveling of the lever 12 can take place by the mere doing of the return spring 14.

On the one hand, the swivel movement caused by the effect of the control stop 18 is relatively large, and, on the other hand, the lever 12 may jam as it is still swiveling slightly after the maximum swivel movement of the extractor.

The return stop 17 makes sure that the lever 12 goes back into a position in which the cam 11 no longer holds the extractor 8 in a swiveled position.

Figure 10:
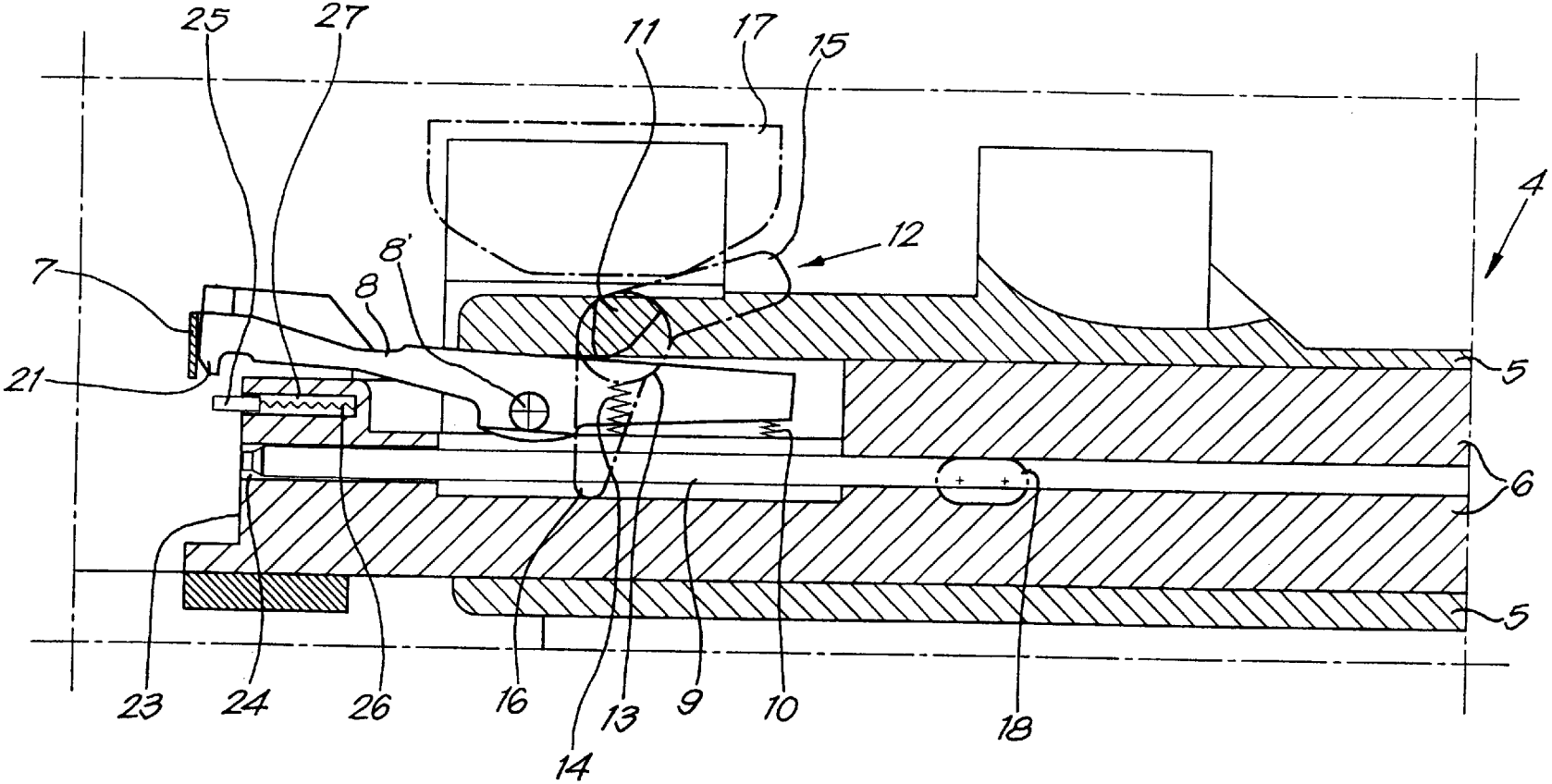

Towards the end of the return movement of the mobile elements 4, the top arm 15 knocks against the return stop 17, as represented in FIG. 10.

The return stop 17 thus forces the lever 12 to return into its starting position as represented in FIG. 4, in which the cam 11 no longer exerts any pressure on the extractor 8, after which the above-described cycle can start again.

The lever 12 has for a result that the extractor 8 releases the casing 22 with absolute certainty when it actually must be ejected.

It is clear that numerous modifications can be made to the above-described example while still remaining within the scope of the invention.

In particular, the barrel 2 must not necessarily be fixed in relation to the frame 1. The invention can for example be applied to a fire arm of the type with a mobile barrel.

The fire arm must not necessarily be provided with guiding stops 19 and 20, and even the return stop 17 could possibly be omitted in the casing where the return spring 14 can guarantee the return of the lever 12 into its starting position at the end of the forward return of the mobile elements 4.

What is claimed is:

1. A fire arm having an automatic or manual cycle, and wherein a forward ejection of a spent cartridge casing or an ejection of such casing is produced, said fire arm comprising:

a frame;

a barrel mounted on said frame, said barrel including a fire chamber; and mobile elements which are arranged to move backward in relation to the frame during recoil;

said mobile elements comprising:

an extractor operable to engage and carry along a casing during recoil motion of the mobile elements and a closing element to close the fire chamber;

said fire arm further including an ejection device having an ejector mounted in said closing element, and a guiding device which guides a spent casing during the recoil of the mobile elements and during extraction, and which causes such cartridge casing to tilt and to be guided in a forward direction during ejection;

said fire arm further including a lever mounted next to the extractor in a pivotal manner on one of the mobile elements;

said lever connected to a rotatable eccentric cam arranged so as to engage and cooperate with the extractor when rotated, said extractor mounted so as to pivot about a first transverse axis, such that, when the lever pivots, said cam rotates and causes the extractor to pivot about said first transverse axis and to disengage the casing;

said frame including at least one control stop located in the trajectory of the lever during forward movement of the mobile elements, said control stop engaging the lever to cause it to pivot during such forward movement at the moment when the casing must be disengaged from the extractor.

2. The fire arm of claim 1, wherein the mobile elements include a slide, and the lever is mounted so as to be pivotable about a second transverse axis.

3. The fire arm of claim 1, including a device configured and located to cooperate with the lever and to rotate the lever back, after an initial pivoting of the lever, into a position at which the cam does not interfere with pivotal motion of the extractor to an initial position whereat the fire chamber is closed.

4. The fire arm of claim 3, wherein said device for returning the lever includes a return spring acting on the lever.

5. The fire arm of claim 3, wherein said device for returning the lever includes a return stop which is fixed in relation to the frame, and is located more toward a front portion of the firearm than the control stop.

6. The fire arm of claim 5, including at least one guiding stop that is fixed in relation to the frame and which engages the lever at the end of a recoil of the mobile elements.

7. The fire arm of claim 5, wherein the lever includes two arms forming an obtuse angle between them, wherein a top one of the arms cooperates with the return stop and a lower one of the arms cooperates with the control stop.

8. The fire arm of claim 1, wherein the guiding device comprises an ejection lever mounted for pivotal motion about an axis, and including a guiding part provided with a passage for a casing, said ejection lever arranged to swivel between a lower position at which the entry of its passage is located in the trajectory of the casing when the mobile elements return forward, and a top position; said ejector further including a button arranged to eject the casing outside of the passage when the ejection lever approaches its top position.

9. The fire arm of claim 1, wherein the ejector is mounted near the extractor, so that the ejector exerts an insubstantial torque on a casing engaged by the extractor.

10. The fire arm of claim 9, wherein the ejector comprises a button with a spring mounted in an opening in the closing element.

* * * * *